US006442876B1

(12) United States Patent
Morse

(10) Patent No.: US 6,442,876 B1
(45) Date of Patent: Sep. 3, 2002

(54) MULTIPURPOSE INDOOR SNOW REMOVAL SYSTEM AND METHOD OF USING SAME

(76) Inventor: Michael V. Morse, 14450 Reuter Strasse Cir. 701, Tampa, FL (US) 33613

( * ) Notice: Subject to any disclaimer, the term of this patent is extended or adjusted under 35 U.S.C. 154(b) by 0 days.

(21) Appl. No.: 09/590,734

(22) Filed: Jun. 8, 2000

(51) Int. Cl.[7] ..... E01H 5/00
(52) U.S. Cl. ..... 37/196; 37/197
(58) Field of Search ..... 37/196, 197, 219, 37/227, 229, 195, 466; 285/131.1, 133.11, 125.1, 8

(56) References Cited

U.S. PATENT DOCUMENTS 1,773,643 A * 8/1930 Romanchak ..... 137/603
2,505,303 A * 4/1950 Randa ..... 285/18
2,525,419 A * 10/1950 Mellinger et al. ..... 128/229
3,456,368 A * 7/1969 Jacques ..... 37/12
3,612,035 A * 10/1971 Kronen ..... 126/271.1
4,032,090 A * 6/1977 Thornton-Trump ..... 244/134 C
4,319,851 A * 3/1982 Arthur ..... 401/137
4,815,769 A * 3/1989 Hopperdietzel ..... 285/41
5,549,875 A * 8/1996 Laughlin et al. ..... 422/266
5,845,848 A * 12/1998 Amako et al. ..... 239/129
5,879,029 A * 3/1999 Wilks ..... 285/8

* cited by examiner

*Primary Examiner*—Victor Batson
(74) *Attorney, Agent, or Firm*—Pendorf & Cutliff

(57) ABSTRACT

A method of using a multipurpose indoor snow removal system for snow removal including uncoupling the hot or cold water supply of an indoor sink and attaching the main supply pipe to a fluid flow control pipe. Then one of the fluid outlets of the fluid flow control pipe is connected to the sink faucet and another of the fluid outlets to a flexible hose and aim the hose to allow water to be released from the fluid release end of the hose for melting the snow off a structure and around a structure.

17 Claims, 10 Drawing Sheets

MULTIPURPOSE INDOOR SNOW REMOVAL SYSTEM AND METHOD OF USING SAME

BACKGROUND OF THE INVENTION

Field of the Invention

The present invention relates to a multipurpose snow removal system and more particularly pertains to retrofitting the snow removal system to indoor plumbing and the method of using the snow removal system for outdoor snow removal.

DESCRIPTION OF THE RELATED ART

In northern climates, the problem of snow accumulation on rooftops, around the base of buildings, on vehicles, and in walkways during the winter is significant for several reasons. As it relates to rooftops, the continual accumulation of snow causes a weight-loading problem which, over the period of a winter, may damage structural roof members, and has on occasion caused a roof to collapse. Further, snow accumulation on rooftops is subjected to alternate heating and cooling during winter days and nights, causing moisture to run down the roof surface and accumulate in the form of ice formations along the eaves of the structure. The ice formed on the eaves can be dangerous. Heat absorbed by the roof surface from inside, and from the sun on the outside of the structure, causes the snow accumulation to begin melting, but no heat is present over projecting eaves, and the water from melted snow re-freezes when it runs down to the projecting unheated eave surface. Accumulation of ice formed along the eaves soon causes water to be dammed and thereby prevented from running off the roof, and this water eventually seeps up underneath shingles to leak into the inside of the structure.

Furthermore, snow accumulation on the ground around the structure and on walkways cause additional problems. The snow around the base of the structure affects the heat level within the structure. Snow accumulation on walkways makes them impassable and dangerous. Snow accumulation on vehicles can make them inoperable if the snow is not first removed from the front and rear windows.

Problems such as the ones described above have been solved in the past with the use of the various prior art references. By way of example, the prior art includes U.S. Pat. No. 5,524,369, to a snow removal device for pulling down sections of snow from a roof. The device permits a user to subdivide and then pull down sections of snow accumulated on a roof or other surface. The device has an elongated handle that supports an oppositely disposed blade and cutter. The cutter has a taut wire between the side struts. The wire is attached to a top edge of the blade. The user draws the cutter through a section of snow, subdividing a rectangular slab of snow from the accumulated snow, then flips the device over and removes the slab with the blade. The U.S. Pat. No. 5,524,369 teaches a manual snow removal device and not a snow-melting device.

The invention of Mittelstadt, U.S. Pat. No. 3,998,486, teaches an apparatus for removing snow from an inclined surface such as a structural roof. The apparatus of the invention includes an elongated flexible sheet having a low surface coefficient of friction, and adapted for sliding along the inclined surface, the sheet being attached to a rod and the rod having an attachment for propelling the apparatus. The Mittelstadt patent functions much like the U.S. Pat. No. 5,524,369 patent for snow removal. The rods of Mittelstadt cut through the snow like the side struts of the 369 patent. The apparatus of Mittelstadt is a manual snow removal device and requires a great deal of physical exertion to remove the snow.

To reduce the physical labor required with manual snow removal apparatus, non-manual snow-melting devices which use electrical heating element have been invented. U.S. Pat. No. 3,989,925 to Garner is such a device. Garner teaches a portable device for melting ice and snow. Additionally, there is U.S. Pat. No. 3,898,429 to Chodak, which teaches a portable electric water-heating device.

Garner teaches a portable device for melting ice and snow. The device has a support with a heating device. The support carries the heating device and a switch for activating the heating device and deactivating the heating device when the pivotal angular relationship between the support and the handle is changed a given degree. The device of Garner has a tank with an electrical heater secured thereto. The tank has a multiplicity of heating and distributing tubes mounted on the tank. The tank may have a liquid contained within the tubes. During use, the device of Garner is positioned on the roof with ice or snow. When the tank is on the roof, the fluid in the tank is heated up by the heater. The tank, once heated, is run across the ice or snow to cause it to melt.

U.S. Pat. No. 3,898,429 teaches a portable electric water-heating device which is a portable snow melter that is manually operated. The device has a hollow handgrip of dielectric material having attached thereto an elongated wand carrying a discharge chamber. The grip is provided with a hose connection for supplying a flow of water to the interior of the grip. A manually operated valve is provided on the grip for selective control of the water flow. An electrical resistance wire helix is located in the grip for raising the temperature of the water as it flows through the grip. The wand conveys the heated water to a series of discharge nozzles in the discharge chamber wherefrom the heated water is ejected toward a snowy surface to melt the snow.

The references set out above either remove snow manually or melt the snow by using a device that requires the user to exert a great deal of physical effort. The prior art references generally are labor intensive, can cause back strain, require a certain amount of strength from maneuvering the apparatus, and in some instances, are generally unsafe to use.

Therefore, it can be appreciated that there exists a continuing need for a snow removal system which can be easily and safely used by the consumer with out being a physical strain and possibly harmful.

SUMMARY OF THE INVENTION

The primary object of the present invention is to provide a novel system of melting snow along the exterior of a building or other structure with the use of an apparatus that is retrofitted onto indoor plumbing.

It is an object of the present invention to provide a fluid-control pipe that that can be retrofitted to indoor plumbing to create a multipurpose indoor snow removal system which solves many of the hazards with the prior art snow removal devices and systems, such as manual removal of the snow through the use of devices that can result in back and shoulder strain.

It is another object of the present invention to provide a fluid-control pipe which may be easily and efficiently manufactured and marketed because it is made of light-weight plastic.

A further object of the present invention is to provide a multipurpose indoor snow removal system that uses the fluid-control pipe to control water flow for snow removal.

Another object of the present invention is to provide a unitary fluid-control pipe which is of a durable and reliable construction, and not bulky, so to allow persons of different strength levels to retrofit the apparatus to indoor plumbing.

Still yet another object of the present invention is to provide a method of using a multipurpose indoor snow removal system for snow removal that is superior to the apparatus of the prior art by being easy to use and overcomes the physically harmful disadvantages normally associated with using the snow removal devices of the prior art.

Still another object of the present invention is to provide a indoor snow removal system to provide a fluid-control pipe that is easily retrofitted to the standard indoor plumbing without the need for special tools.

Yet still another object of the present invent is to provide a method that rapidly removes snow from structures, vehicles, and the areas surrounding those structures.

Further still, the present multipurpose indoor snow removal system is not limited to being used to remove snow. The present invention may be safely used for other jobs interior the structure and exterior the structure.

After extensive study and testing of various ways to remove snow from the roof, balcony, car, or driveway without having to use a shovel or blower, the present inventor discovered that by retrofitting his snow removal system to the interior cold/hot water plumbing or hot water plumbing singularly, snow could be safely, easily, and economically melted away.

Accordingly, a primary method of using a multipurpose indoor snow removal system for snow removal is to provide a way to retrofit indoor plumbing and transform the indoor plumbing to a snow removal system for exterior use, while maintaining the integrity of the existing interior plumbing. As such, the general purpose of the present invention will be described subsequently in greater detail.

To attain this, the present invention is essentially a system of removing snow using a multipurpose indoor snow removal system is retrofitted to the plumbing of an indoor sink. In use, the hot water fluid line is uncoupled from the sink faucet of a main hot water supply pipe. The fluid-control pipe is coupled to the main hot water supply pipe at the fluid inlet end. Further, the fluid-control pipe has at least two fluid outlets with one of the fluid outlets coupled to the hot water fluid line of the sink faucet. To complete the indoor snow removal system, another of the fluid outlets has dual fluid release ends wherein each has a fluid control formed thereon. One free end of the dual fluid release ends has a flexible hose coupled thereto, with the flexible hose having a control means at a fluid release end. The other free end of the dual fluid release ends may be coupled to the cold water line of the sink.

The main hot water supply is turned on, and hot water flows into the fluid-control pipe of the indoor snow removal system to be released into the flexible hose. As the water fills the flexible hose, the flexible hose is extended beyond the indoor sink for extending to the exterior of a building housing the sink. The user of the indoor snow removal system then aims the flexible hose at a structure for snow removal and clearing away. The hot water is allowed to flow from the main hot water supply pipe of the sink for spraying onto the structure to melt the snow with the hot water being released from the fluid release end of the flexible hose.

The snow is melted from the area of the structure leaving area free of snow. The indoor snow removal system can be coupled to the cold water main supply pipe in the same manner. Furthermore, the cold water can be allowed to enter into the fluid-control pipe for mixing with the hot water as it is released through the flexible hose.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one method of snow removal used by the inventor in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated preferred embodiments of the invention.

BRIEF DESCRIPTION OF THE DRAWINGS

The invention will be better understood, and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
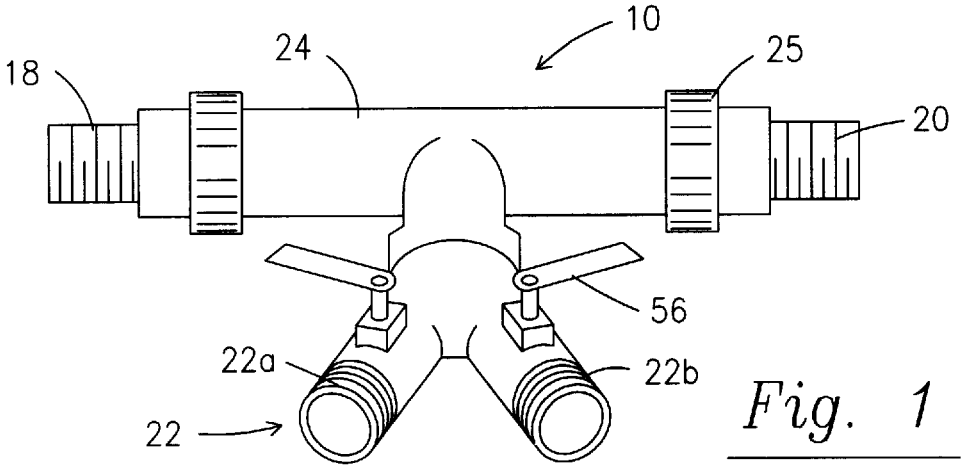
FIG. 1 is a perspective illustration of a first alternative embodiment of the fluid-control pipe constructed in accordance with the principles of the present invention.

With reference now to the drawings, and in particular to FIGS. 1–18 thereof, showing the multipurpose indoor snow removal system for use in snow melting for removal of the snow embodying the principles and concepts of the present invention.

The present invention, the method of using the multipurpose indoor snow removal system for snow removal, is comprised of a series of steps required to retrofit the fluid-control pipe of the indoor snow removal system to existing plumbing for water release through a flexible hose exterior the building housing the indoor hydrant.

More specifically, the present invention is a method of removing snow using a multipurpose indoor snow removal system that is easily retrofitted to indoor plumbing. Preferably, indoor sink plumbing, however, any indoor plumbing which has hot and cold water flowing into the building via standard indoor plumbing is useful.

Through experimentation, the inventor discovered that by using the indoor snow removal system, he was able to prevent snow buildup on the tops of buildings, which prevented the creation of a snow cap. Snow accumulation or the formation of snow caps on the buildings roof top causes an internal temperature change of the attic and ceiling of the building. Further, snow accumulation around the foundation of the building causes a lowering of the internal temperature of the building. When the inside temperature changes and gets colder, the consumer will turn up the thermostat on the heating unit thus increasing their energy usage. The more snow accumulation on and around the building, the colder the inside becomes and the more energy required to heat the interior to a comfortable level. The inventor has found that by completely removing the snow from the building top and clearing an area 4–5 feet from the foundation of the building, heat loss from the building is reduced. Using the indoor snow removal system during the course of the winter months greatly reduces energy cost.

The major components of the indoor snow removal system are a unitary fluid flow control pipe 10, a hot water supply line 26, a faucet line 3, 4 of a sink, and a flexible hose 40 being coupled to one of the fluid outlets 22, wherein the flexible hose is extended outwardly from the indoor sink to the outside for releasing hot water onto the snow.

Figure 2:
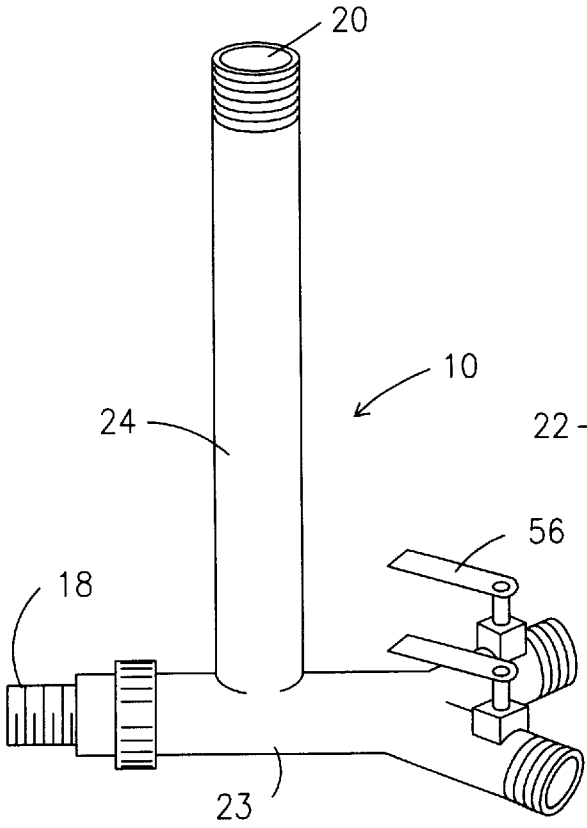
FIG. 2 is a perspective view of the preferred embodiment of the fluid-control pipe.

The fluid-control pipe comes in a variety of shapes and material. Preferably, the fluid-control pipe is a unitary pipe, as shown in FIG. 2, that has a fluid inlet 18 and two fluid outlets 20, 22. One of the fluid outlets having dual fluid release ends 22*a* and 22*b* with each having a fluid control. The fluid inlet and one of the two fluid outlets may be formed by a pipe of rigid or flexible material. The fluid-control pipe as shown in FIG. 2, has a pipe 24 with the pipe for the fluid inlet having a length greater than the pipe for the fluid outlets.

Figure 3:
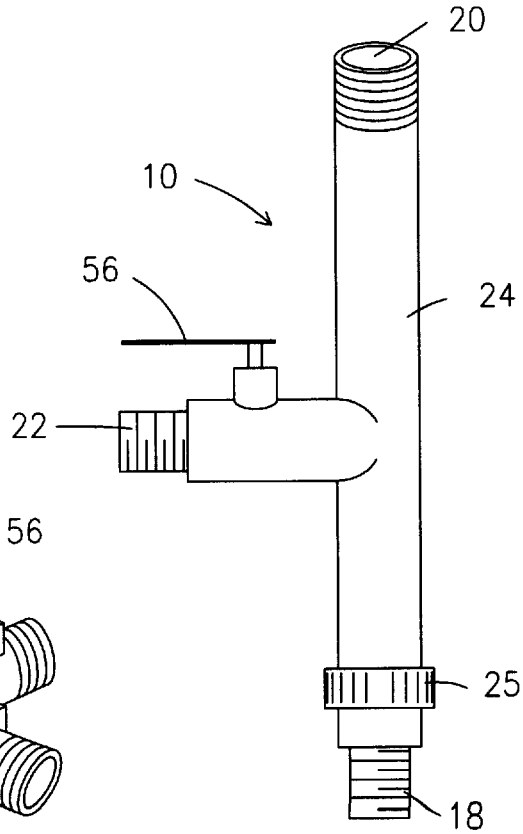
FIG. 3 is a perspective view of a second alternative embodiment of the fluid-control pipe.
Figure 8:
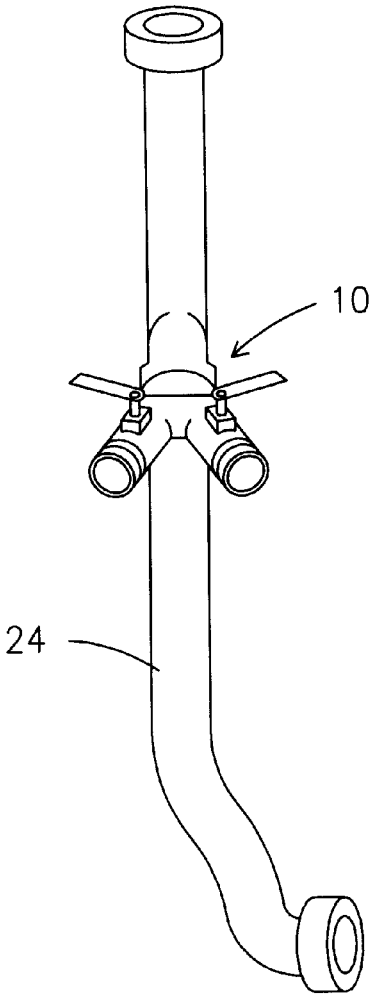
FIG. 8 is a frontal view of a fifth alternative embodiment of the fluid-control pipe wherein the linearly extending pipe portion is flexible.
Figure 9:
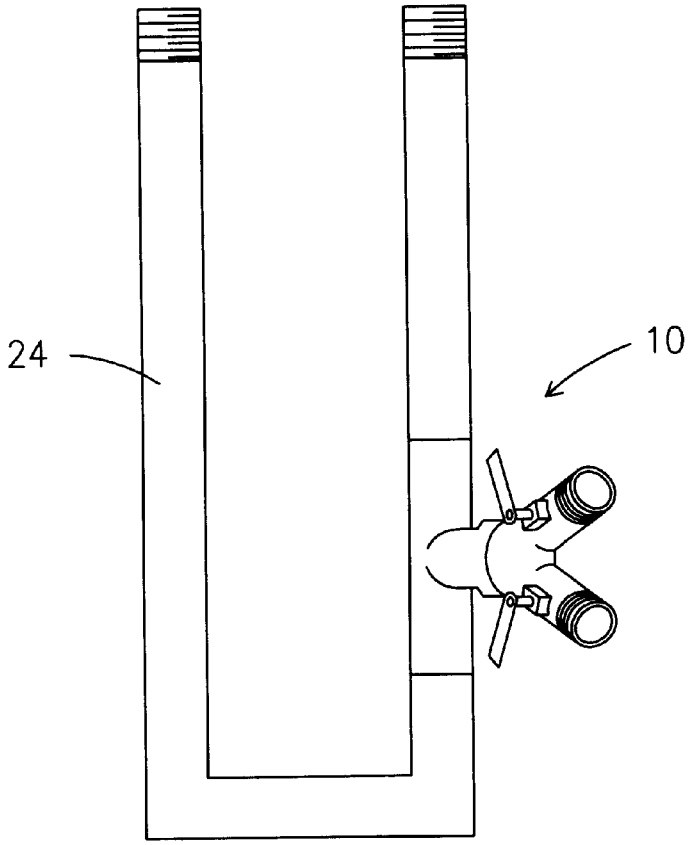
FIG. 9 is a frontal view of a sixth alternative embodiment of the fluid-control pipe wherein the linearly extending pipe portion has a generally U shape.

Further, the pipe 24 for the fluid inlet and one of the three fluid outlets may be linear as seen in FIGS. 1 and 3; formed of a linear pipe piece interconnected with a perpendicular pipe piece as shown in FIG. 2; or U shaped as shown in FIG. 9. In FIG. 8, the pipe for the fluid inlet and one of the two fluid outlets is flexible and has no defined shape. The fluid-control pipe is designed to allow fluid to flow in through the fluid inlet and out through the two fluid outlets for fluid release on the exterior of the structure housing the indoor plumbing, in the area of the structure leaving area free of snow and fluid release through the sink faucet.

Figure 10:
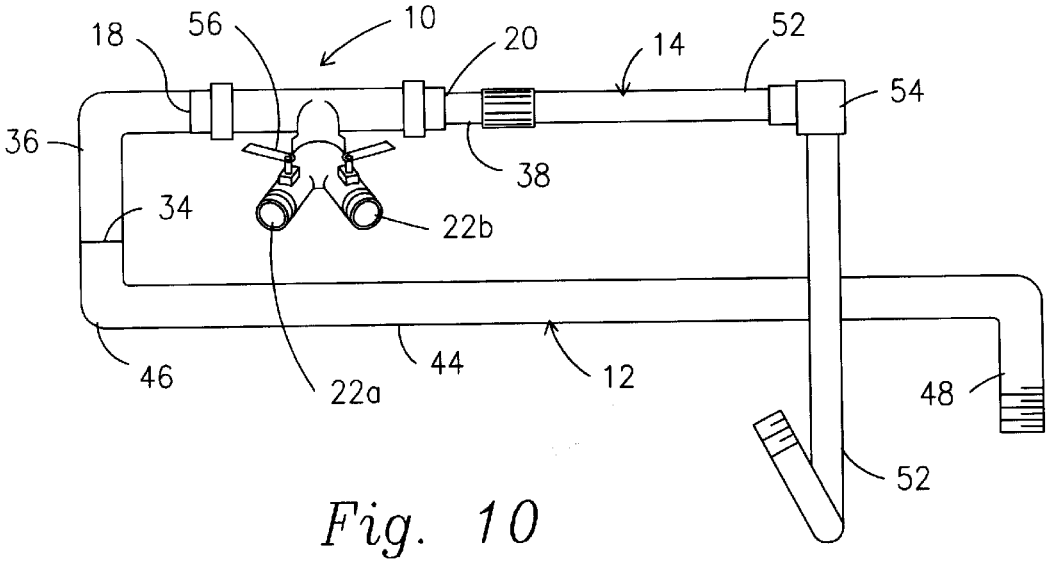
FIG. 10 is a frontal view of the indoor snow removal system.
Figure 11:
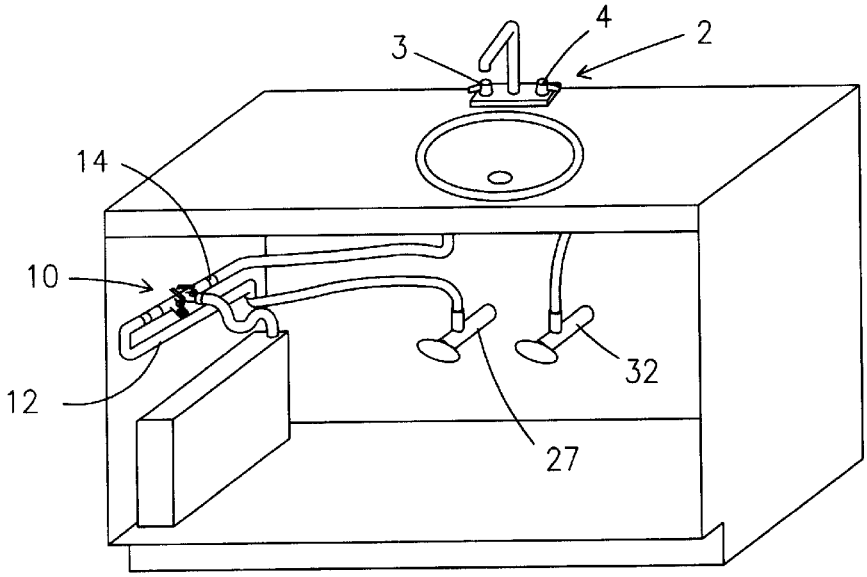
FIG. 11 is the indoor snow removal system in an operational orientation of the embodiment of FIG. 1 mounted in a sink cabinet.
Figure 12:
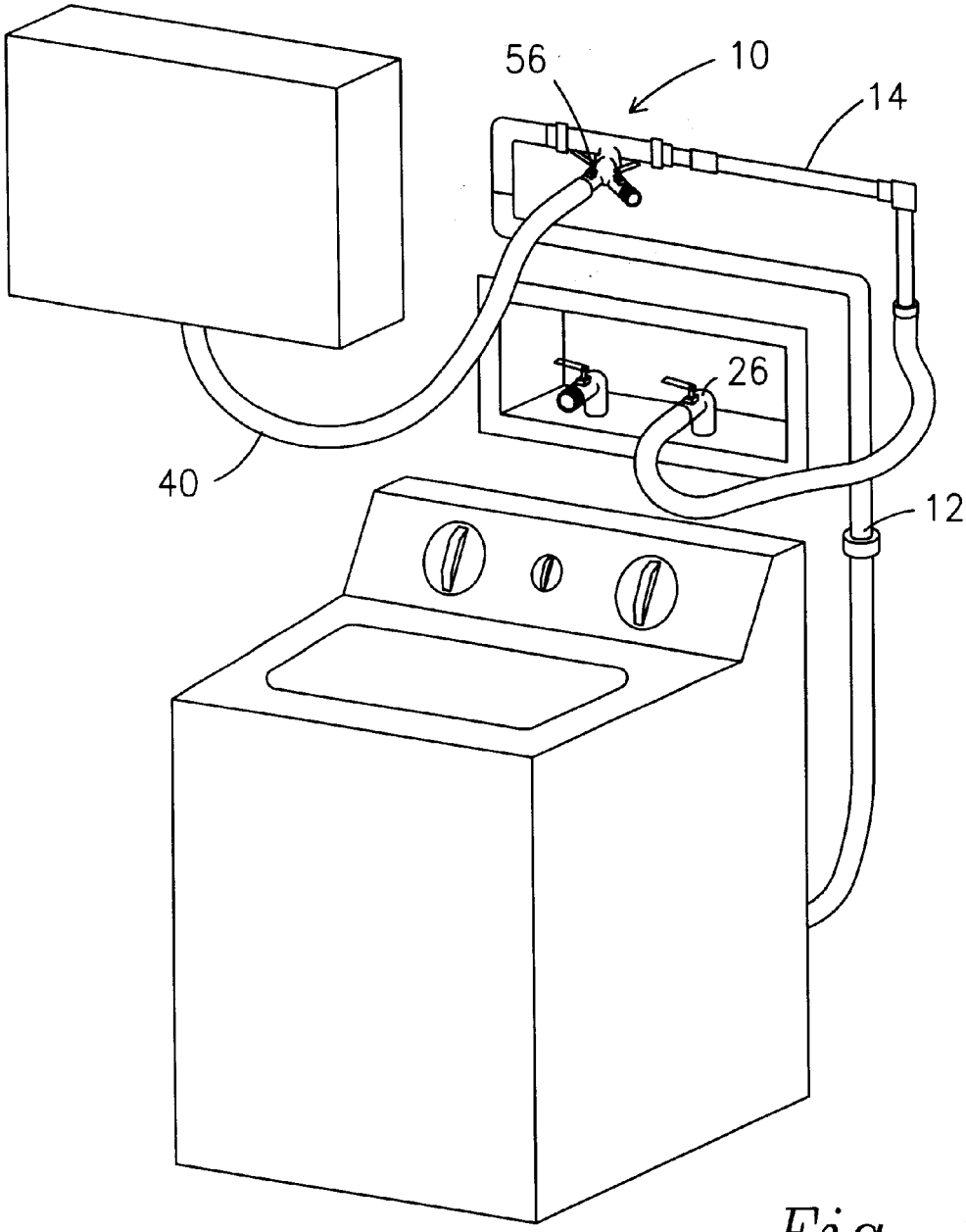
FIG. 12 is the indoor snow removal system in an operational orientation of the embodiment of FIG. 1 mounted above a washer unit.
Figure 13:
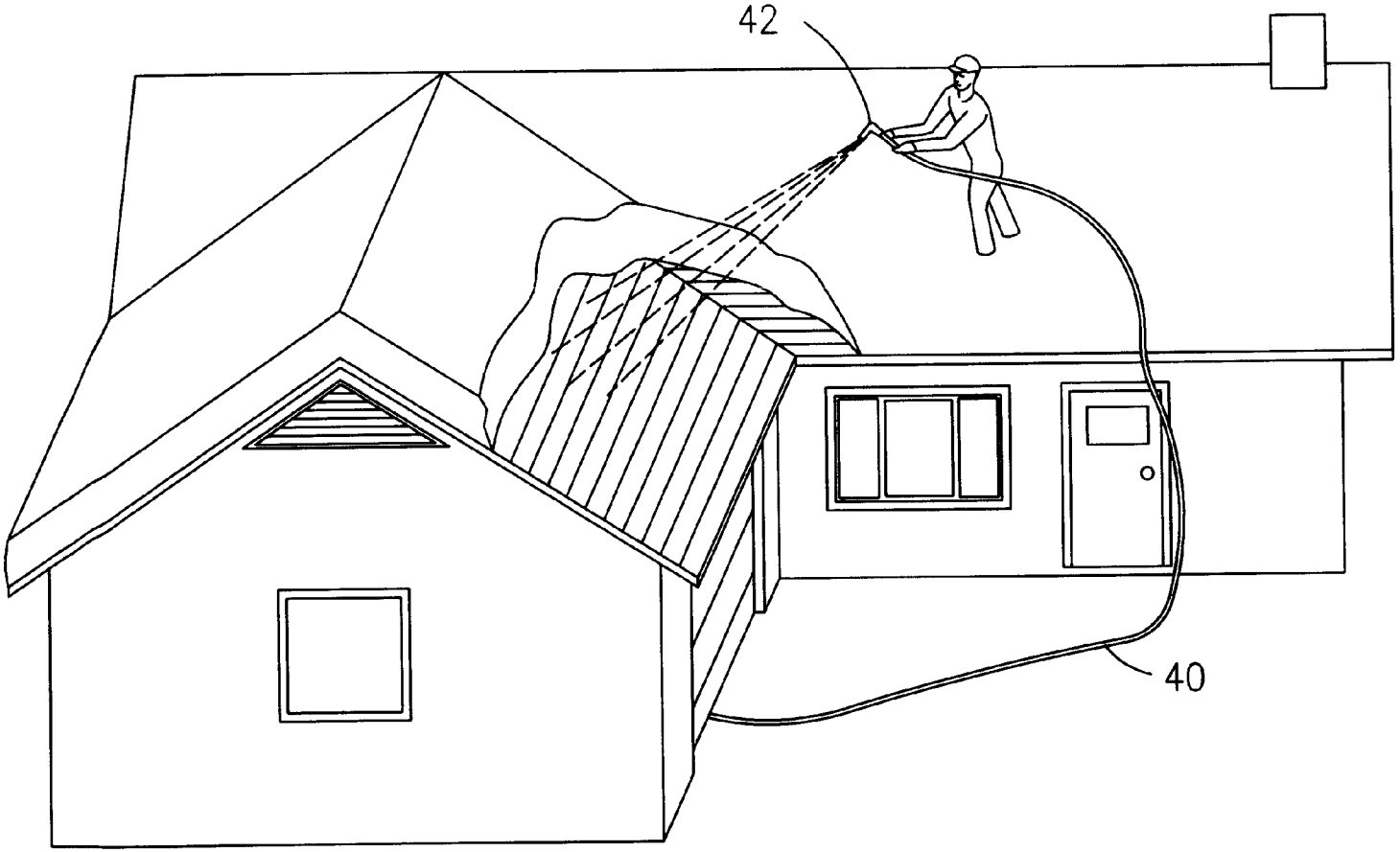
FIG. 13 is a perspective view of the indoor snow removal system shown on removing snow from a building rooftop.
Figure 14:
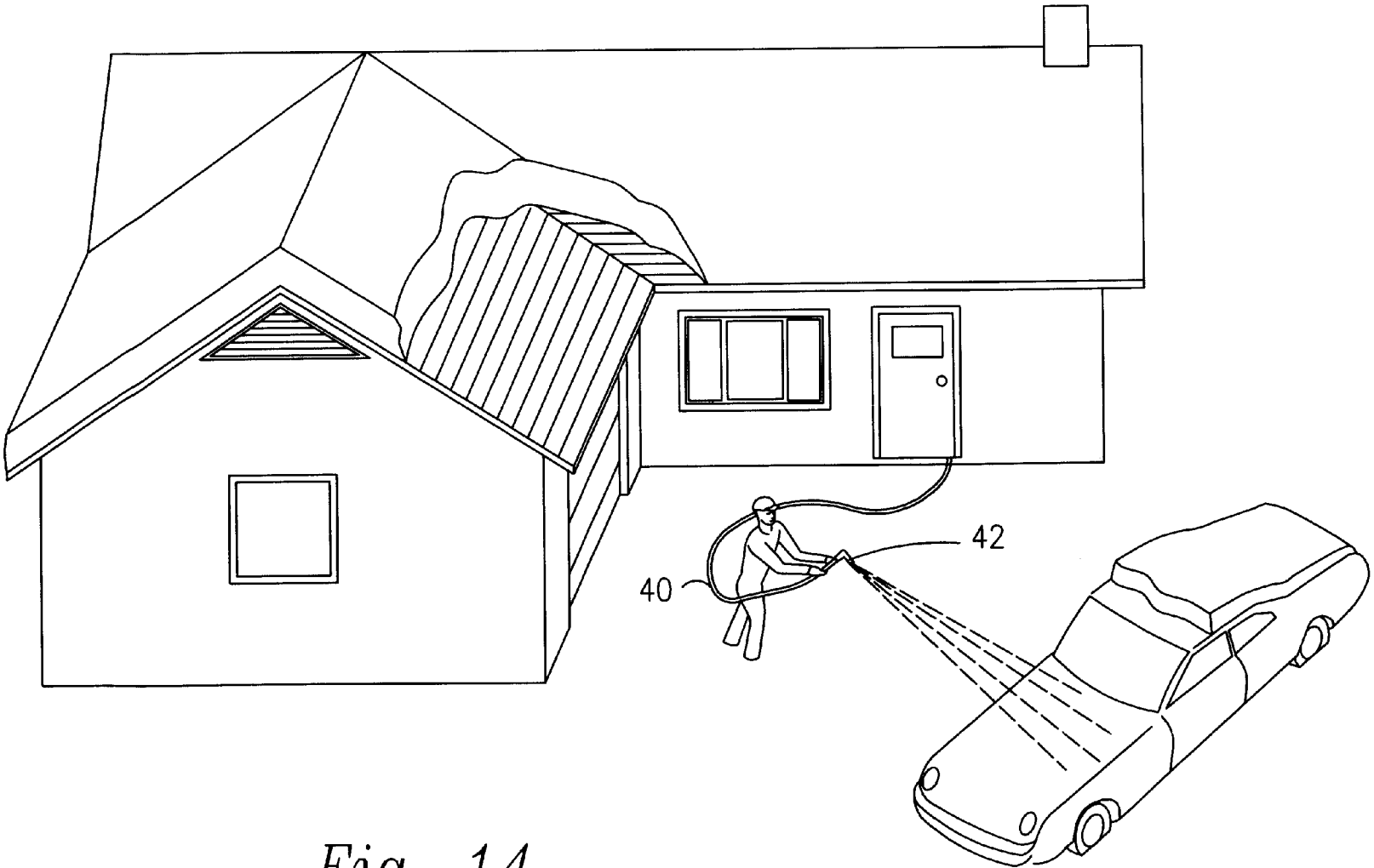
FIG. 14 is a perspective view of the indoor snow removal system shown removing snow from a vehicle.
Figure 15:
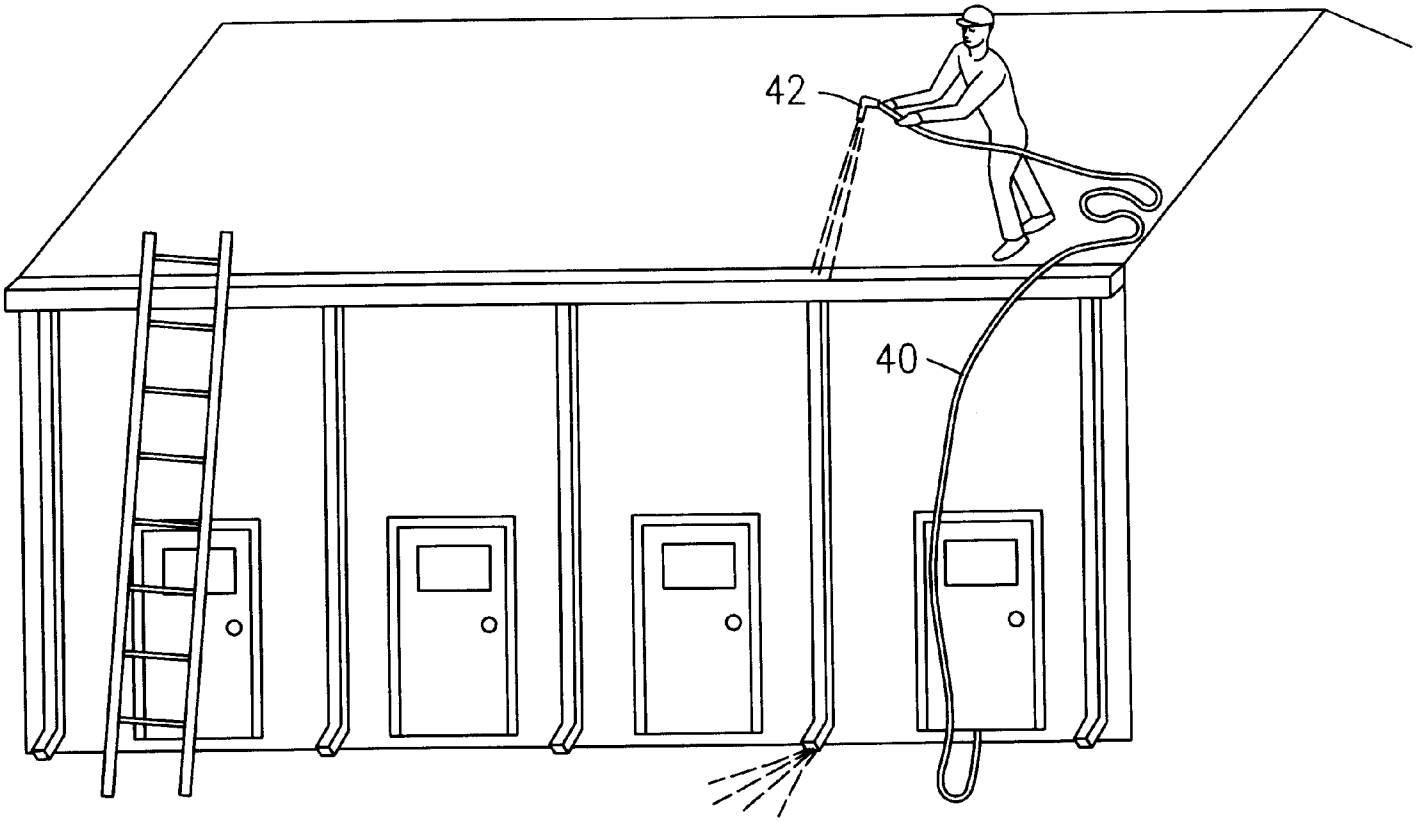
FIG. 15 is a perspective view of the indoor snow removal system shown removing snow from gutters.
Figure 16:
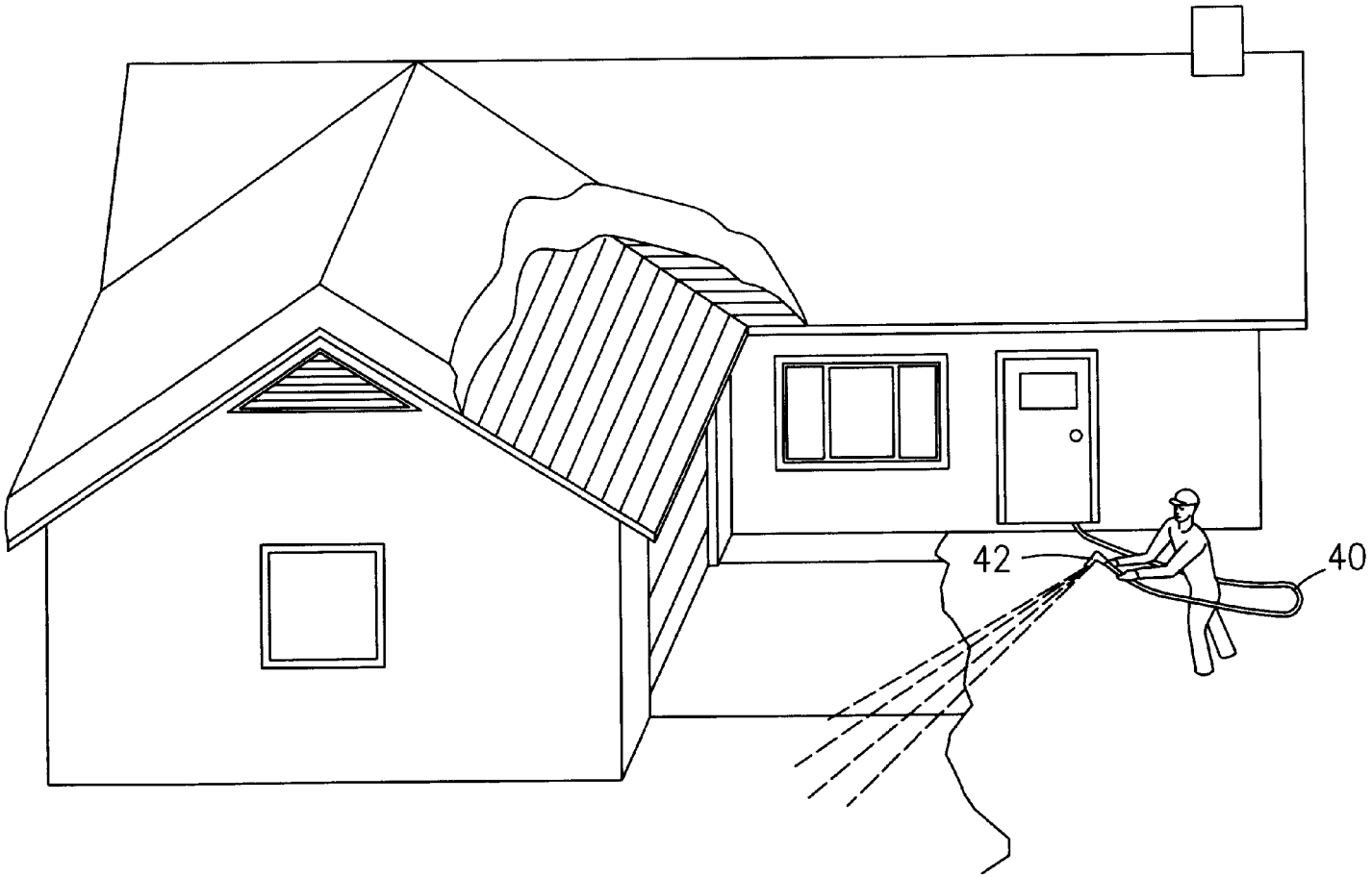
FIG. 16 is a perspective view of the indoor snow removal system shown removing snow from around the building and the walkway.

An alternative indoor snow removal system, as shown in FIGS. 10–12, shows the fluid-control pipe 10 of FIGS. 1 and 3 in use under the sink and connected with extension pipes. Wherein included is a first pipe extension 12 and a second pipe extension 14. The fluid-control pipe has a fluid inlet 18 and two fluid outlets 20, 22 with the one fluid outlets 20 being coupled with the second pipe extension. The fluid inlet is connected to the with first pipe extension. The dual fluid release ends 22*a*, 22*b* are free.

The inner portion of the fluid-control pipe will be of the same size and SDR as used in the plumbing trade. Specifically, the unitary fluid-control pipe, when retrofitted to a sink faucet 2, has an internal diameter so to not overload the fluid flow into the sink faucet.

The length of the first pipe extension and the second pipe extension, when use with the fluid-control pipe of FIG. 1, is greater than the length of pipe 24 of the fluid-control pipe. The length of the first pipe extension and the second pipe extension ranges from 1 ft. to 3 ft.

While the invention contemplates the use of PVC pipe for construction of the flow control pipe, the first pipe extension and the second pipe extension, galvanized pipe, steel tubing, or other standard pipe stock could be used as a substitute for the pipe extensions. However, PVC pipe (polyvinylchloride plastic or resin pipe) is preferred because of the ease and low cost associated with replacing a damaged indoor snow removal system and the availability of pipe at a relatively inexpensive cost.

Other known plastic materials that are suitable for use in forming the indoor snow removal system of the present invention are those known as ABS (acrylonitrile-butadiene-styrene plastic), high impact PS (polystyrene plastic), PP (polypropylene plastic or resin), and various other plastics including buterates, acrylics, cellulosics, and acetals. In particular, the wide availability of such heat formable, rigid, and resilient plastics in tubular form provides a ready source of inexpensive material for practice of the present invention. As an example, but without limitation, the commonly available polyvinyl chloride extruded as vacuum formed tubing of 1.35 inches outside diameter, and having a wall thickness of 0.133 inches, is conveniently applicable for practice of this invention.

As stated above, although other types of tubing, and even metallic tubing, may be employed in the practice of this invention, the ease of forming thermoplastic tubing particularly adapts this type of material to the methods of construction and assembly. Further, the PVC couplings making a one-piece unit between the first pipe extension and the flow control pipe and the second pipe extension and the flow control pipe, makes this apparatus perfect for retrofitting on to indoor plumbing.

Figure 17:
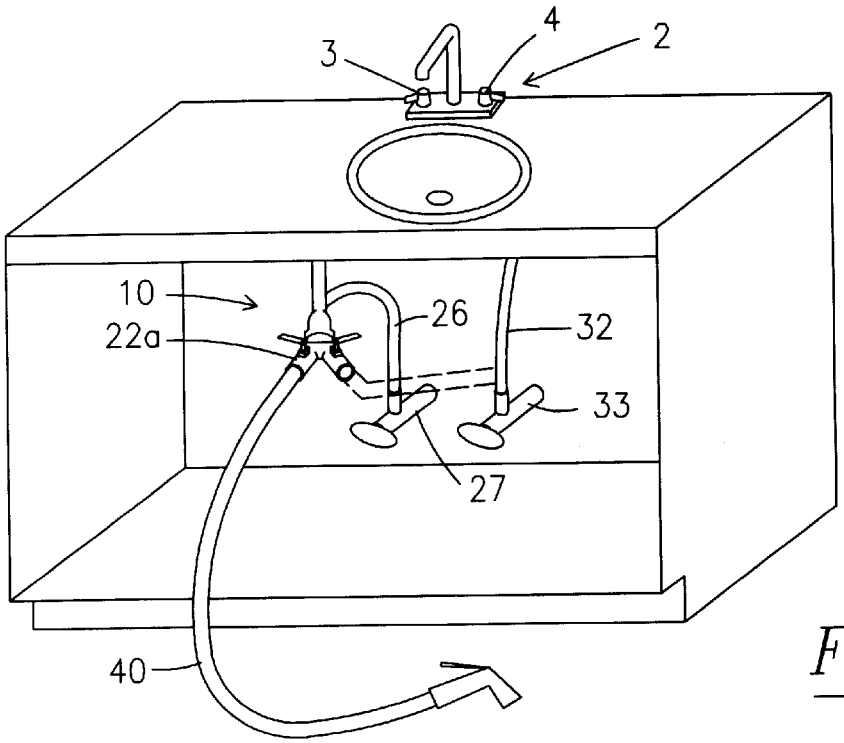
FIG. 17 is the indoor snow removal system in an operational orientation of the embodiment of FIG. 2 mounted under a sink.
Figure 17A:
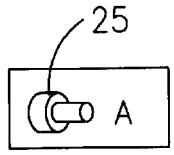
FIG. 17*a* is a side view of a universal coupling.
Figure 18:
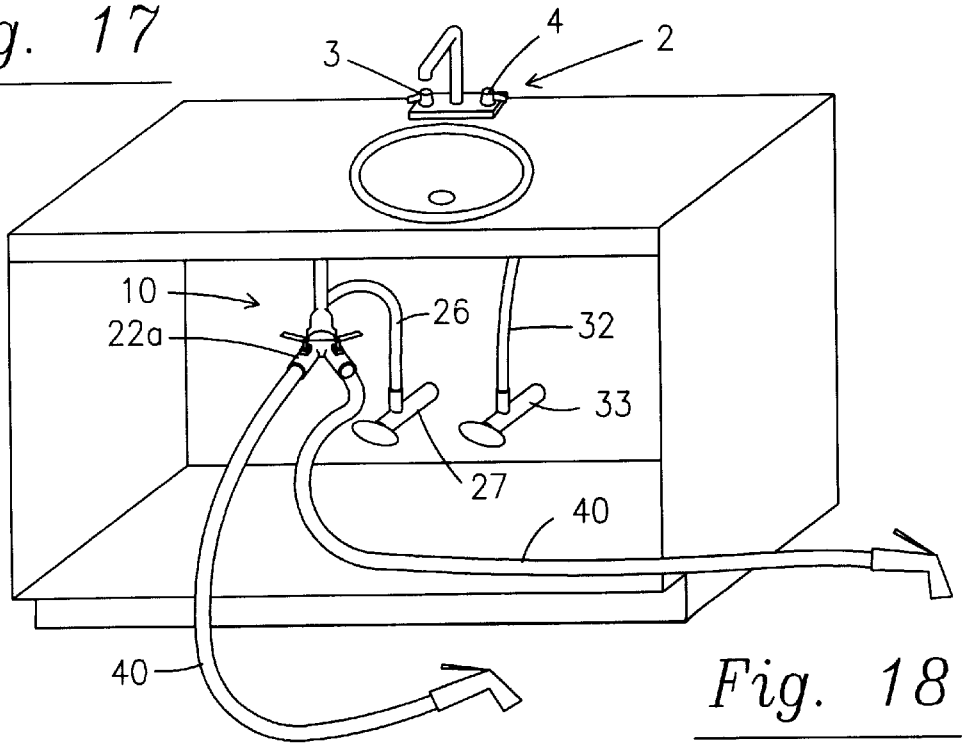
FIG. 18 is the indoor snow removal system in an operational orientation of the embodiment of FIG. 2 mounted under a sink and coupled to two flexible hose.

FIGS. 17 and 18 show the preferred fluid-control pipe retrofitted directly between the main hot water line and the hot water faucet 3 of the sink faucet 2. When the fluid-control pipe 10 is in position one of the fluid outlets 20 is connected to the hot water faucet line, and the fluid inlet 18 is connected to the main hot water inlet line. To direct the hot water out to the exterior of the building housing the sink, one of the dual fluid release ends 22*a* is connected to the flexible hose. In the event the user wants to reduce the amount of water coming from the hot water tank, the other end of the dual fluid release ends may be connected to the cold water line 32 of the sink. When coupling the cold water line 32 to the other end of the dual fluid release ends a coupling 25 is used. As noted in FIG. 17*a*, the coupling has two ends, one a male end and the other is the female end. The male end is connected to the end of the dual fluid release end while the female end couples with the cold water line 32.

It is also possible in both of the above systems to have another of the dual fluid release ends connected to a second flexible hose. This will allow two users to remove snow at the same time. The dual hose hook-up will reduce the work time and allow collective work to be performed in two separate areas during a singe snow removal clean-up.

As illustrated in FIGS. 10–12, of the alternative system, the first pipe extension 12 has a generally Z shape. The Z to shape includes an elongated center section interconnected with a first perpendicular pipe section and a second perpendicular pipe section interconnected at opposite ends. The first perpendicular pipe sections projects away from the elongated center section in one direction while, the second perpendicular pipe section projects away from the elongated center in a direction opposite the direction of the first perpendicular pipe section. The structure of the first pipe extension is not limited to the Z shape. It may be merely a linearly extended pipe portion or whatever structure to accommodate the first pipe extension near the indoor hot and cold water plumbing lines that are in close proximity.

The second pipe extension 14 in the alternative system is either L shaped or linear. In FIGS. 10–12, the second pipe extension is the L shaped. The purpose of the second pipe extension is to carry the water to the sink faucet when the indoor snow removal system is not being used. This allows the indoor snow removal system to remain connected at all times.

The inventor discovered that one of the greatest features of the present system is that all members of the family may use the system. The indoor snow removal system is easily retrofitted to the indoor plumbing by having universal couplings 25 at all ends of the fluid-control pipe, and the ends of the first pipe extension and the second pipe extension. The flexible hose is easily unrolled and lightweight. Water damage to the interior is reduced by using pipe sealing adhesive at the sink connections, and by carrying the fluid release end of the flexible hose outside before turning on the water.

Figure 4:
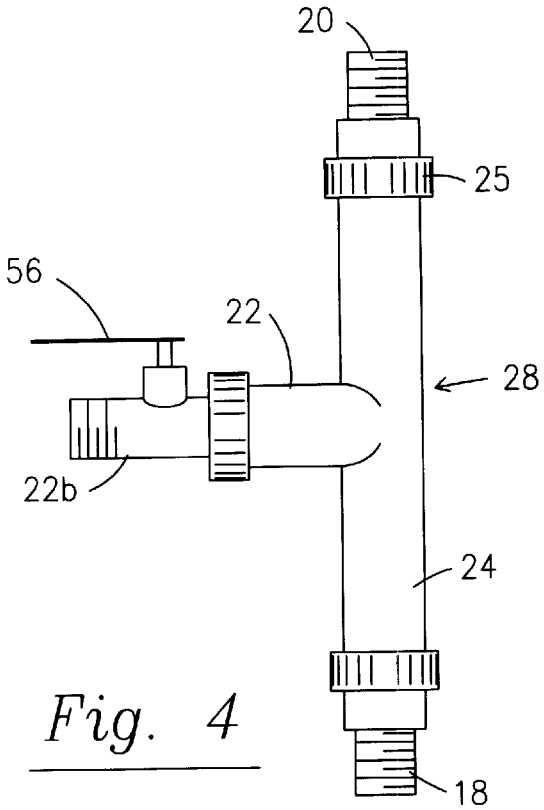
FIG. 4 is a side view of the T connector for mixing hot and cold water.
Figure 6:
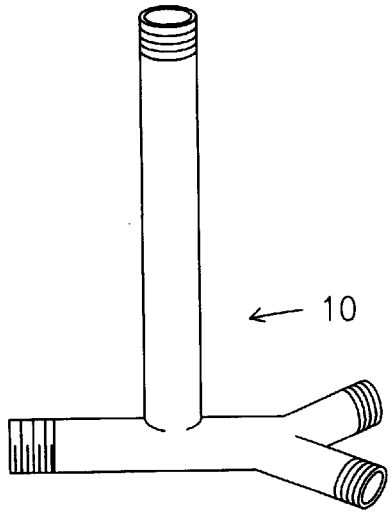
FIG. 6 is a side view of a third alternative embodiment of the fluid-control pipe.
Figure 5:
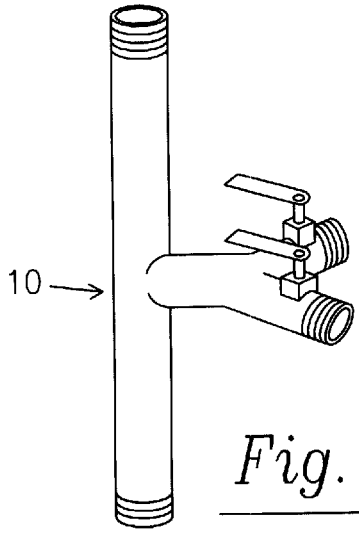
FIG. 5 is a top view of the preferred embodiment of the fluid-control pipe.
Figure 7:
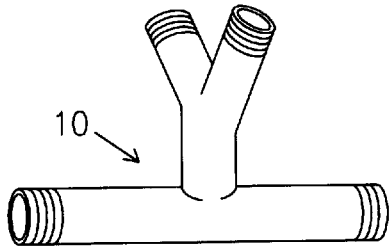
FIG. 7 is a side view of a fourth alternative embodiment of the fluid-control pipe with flexible dual outlets.

In operation, snow removal is easy. The user of the indoor snow removal system couples either the fluid-control pipe or one of the extension pipes to the indoor plumbing. This requires in all cases the uncoupling of the hot water fluid line of a sink faucet 26 from a main hot water supply pipe 27. If the user chooses to use a hot water/cold water mix, the may couple either the coupler 25, as seen in FIG. 17*a* or a "T" connector 28, as shown in FIG. 4, to a cold water connection 32 of a main cold water supply pipe 33 of a sink. The "T" connector is used mainly in the alternative embodiments of FIGS. 10–12 and when the user wants to continue to use the cold water faucet. When the T connector is used, the one end is coupled between the sink faucet line and the main line of the cold water supply, and the other end of the "T" connector is coupled to the main hot water supply pipe of the same sink. The T connector has a shut-off valve for controlling the cold water flow.

When operating the preferred indoor snow removal system for snow removal using only hot water as the supply fluid, the fluid-control pipe is retrofitted between the main hot water line and the hot water fluid line of the sink faucet. Further, in operation, at least one of the dual fluid release ends is connected to the flexible hose. The other one of the dual fluid release ends is either connected to a cold water line or a second flexible hose.

When operating the alternative indoor snow removal system, a first pipe extension is coupled to the main hot water supply pipe. Once this is done, the first pipe extension 12 is mounted near the main hot water supply pipe. The mounting may be to the sink cabinet or the wall. The second pipe extension 14 is coupled to the hot water fluid line of the sink faucet to allow the faucet to continue to operate. The second pipe extension is mounted to the main hot water supply pipe and spaced from the first pipe extension.

Before coupling the first pipe and the second pipe extensions to the main plumbing of the sink and the fluid line of the sink faucet, both are coupled to the fluid-control pipe. A free end 34 of the first pipe extension is coupled to a fluid flow control pipe, as seen in FIGS. 10–12. In this embodiment of FIG. 10, the first perpendicular pipe section has the free end coupled with the fluid-control pipe by way of an "L" pipe connector 36. The free end 38 of the second pipe extension is then coupled to the fluid flow control pipe 10 of the indoor hydrant. For full operation of the indoor snow removal system, a flexible hose 40, with a control means 42 at a fluid release end, is coupled to one of dual fluid release ends of the fluid-control pipe.

Finally, once the flexible hose is extended beyond the indoor sink for extending to the exterior of a building housing the sink, hot water is released into the first pipe extension to allow the flow of hot water into the flexible hose. The user of the indoor snow removal system then aims the flexible hose at a structure or area around a structure, that has snow to be removed and cleared away. The hot water is allowed to flow from the main hot water supply pipe of the sink for spraying onto the structure or surrounding area. The combination of the hot water and the pressure from the hose melts the snow as the hot water is released from the fluid release end of the flexible hose. The snow is melted from the area of the structure leaving the area free of snow. When the user has completed the clearing of the snow, the flexible hose is rolled up and stored in a cabinet mounted anywhere near the system. In the alternative, the user may disconnect the flexible hose and store it in any other convenient location.

The Z shape of the first pipe extension, of the alternative system, has an elongated center section 44 interconnected to the first perpendicular pipe section 46 at one end and a second perpendicular pipe section 48 at another end. This configuration makes it easy for water to flow from the main pipe line into the flow control pipe because the second perpendicular pipe section is projecting outwardly from the elongated center section in a direction opposite the first perpendicular pipe section. The second pipe extension 14 is generally "L" shaped with a pair of elongated pipe sections 52 interconnected at the area of the pipe bend 54.

The dual fluid release ends, at one of the outlet ends of the fluid-control pipe, are angularly spaced one from the other. The angular spacing may range from 30 degrees to 60 degrees. Further, the dual fluid release ends may be of rigid material or flexible material. Each of the dual fluid release ends has a fluid-control valve 56. The fluid-control valve operates as an on and off switch for fluid flowing out of the release ends and into a flexible hose or other pipe. Closing the fluid-control valve prevents fluid from being released. Opening the fluid-control valve releases fluid into the flexible hose or allows one of the release ends to act as an inlet to introduce cold water into the system. When the indoor snow removal system is not in use, both control valves are in the closed position or off position, allowing water to flow into the sink faucet.

In the preferred system, the fluid inlet and one of the two fluid outlets, of the fluid-control pipe of FIG. 2, are formed at pipe 23, which is a linearly extended pipe portion. Also, perpendicular to pipe 23 is pipe 24, which has the other of the two fluid outlets at an end thereof.

In the alternative fluid flow control pipes of the system pipe 24 is a linearly extending pipe portion with end portions that are axially aligned, as shown in FIGS. 1 and 3–8. One end portion of the linearly extending pipe portion, being the fluid inlet and couples with the first pipe extension and the other end portion, being one of the fluid outlets, couples with the second pipe extension. Further, the linearly extending pipe portion has the dual fluid release ends perpendicularly extended from an interconnected pipe piece that forms the second fluid outlet.

In FIG. 8, the pipe 24 of the fluid-control pipe, the fluid inlet and one of the two fluid outlets is formed at a linearly extending pipe portion of flexible material. One end portion of the flexible pipe portion couples with the first pipe extension, and the other end portion couples with the second pipe extension. The linearly extending pipe portion has the dual fluid release ends perpendicularly extending from an interconnected pipe (the second fluid outlet) piece connected along the linearly extending pipe portion.

In FIG. 9, the pipe 24 of the fluid-control pipe has the fluid inlet and one of the two fluid outlets being formed of a "U" shaped pipe portion, formed of a rigid material. The end portions of the U shaped pipe are spaced apart in parallel plans. One end portion of the U shape pipe couples with the first pipe extension, and the other end portion couples with the second pipe extension. The "U" shaped pipe portion has an interconnected pipe piece which is the second fluid outlet perpendicularly extending therefrom. The second fluid outlet has the dual fluid release ends.

It is to be understood that the shape of the pipe 24 for the fluid inlet and one of the two fluid outlets has a variety of shapes to accommodate a variety of indoor sink positions. Each pipe 24 shape operates in the same manner with the indoor snow removal system. Further, all of the dual fluid release ends are connected to a flexible hose. The hose, when not in use, may be stored in a mounted cabinet or merely under the sink.

The various structures that need snow removal for the purpose of this invention include buildings, vehicles, rooftops, balconies, gutters, the area around a building, window seals, porches, flower beds, lawns, driveways and walkways. Snow build-up on or around the structures is dangerous, reduces mobility, and causes energy inefficiency. Snow build-up on the surface areas where people and vehicles move about is also dangerous.

As a side benefit of the indoor snow removal system, alternative uses are available such as; plant watering, filling fish tanks, filling water beds, steam wash vehicles, steam clean pool enclosures and pool decks and refill indoor water coolers.

The benefits of using the indoor snow removal system of this invention follows:

1. Energy Reducer/Economic Savings (New process)

| | |
|---|---|
| (A) Residential | > Structures |
| (B) Commercial | |

2. Cost reduction: Eliminate the cost of and need for multiple apparatus to adequately remove snow from different during the winter months at commercial and residential sites in urban and rural areas.
   Examples
   - Roof Equipment
   - Driveways/sidewalks equipment
   - Automobiles equipment
   - Etc.
3. Reduction in major labor demands: Persons will no longer be required to pay high labor cost do to long hours spent manually removing snow at commercial and residential sites during the winter months.
4. Location: The ability of the multipurpose indoor snow removal system to be easily assembled and retrofitted onto all standard sink piping makes installment easy, and eliminates the need for any type of special installation tools. Simple tools that are generally available in the basic tool kit convert the average plumbing fixtures to the useful apparatus.
5. User friendly: The method of the present invention allows a broader number of people to effectively and efficiently address and resolve as needed a major seasonal problem, at a more rapid rate than is available through current equipment and processes used.
   Examples
   - Teens
   - Young
   - Elderly
   - Children
   - Old
   - Adults
   - Disabled
6. Cold & hot water integration: By retrofitting a connector between one of the dual release ends and the cold water line or the first extension and the cold water line, cold water can be integrated into the system. The integration of cold water greatly reduces hot water usage thereby reducing electrical cost. (fewer tanks of water need to be heated up)

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed is as follows:

1. A multipurpose indoor snow removal system for removing snow being retrofitted to the plumbing of an indoor sink, comprised of:

a unitary fluid flow control pipe with a fluid inlet and at least two fluid outlets, and one of the two fluid outlets is formed of dual fluid release ends;

a hot water fluid line coupled to the fluid inlet;

a faucet line of a sink being coupled to one of the fluid outlets;

a flexible hose being coupled to another of the fluid outlets, wherein the flexible hose is extended outwardly from the indoor sink to the outside for releasing hot water onto the snow; and wherein each of the dual fluid release ends has a valve that can be opened and closed with a fluid control.

2. The multipurpose indoor snow removal system for removing snow as in claim 3, wherein the fluid inlet and fluid outlets are made of a rigid material.

3. The multipurpose indoor snow removal system for removing snow as in claim 3, wherein the fluid inlet and at least one of the fluid outlets are made of a flexible material.

4. A method of using a multipurpose indoor snow removal system to remove snow, which comprises:

uncoupling a hot water fluid line of a sink faucet from a main hot water supply pipe;

coupling a first pipe extension to the main hot water supply pipe;

coupling a free end of the first pipe extension to a fluid flow control pipe at a fluid inlet;

coupling a second pipe extension to the hot water fluid line of the sink faucet;

coupling a free end of the second pipe extension to the fluid flow control pipe at a fluid outlet;

mounting the first pipe extension near the sink such that the second pipe extension is mounted near the main hot water supply pipe and spaced from the first pipe extension;

coupling a flexible hose to another fluid outlet of the fluid control pipe;

releasing hot water into the first pipe extension to allow the flow of hot water into the flexible hose;

extending the flexible hose away from the indoor sink to the exterior of a building housing the sink;

aiming the flexible hose at a structure having snow to be removed by allowing hot water to flow from the main hot water supply pipe of the sink to be sprayed onto the structure to melt the snow and leave the area free of snow.

5. The method of using the snow removal system as set forth in claim 4, wherein the first pipe extension is a generally "Z" shaped with an elongated center section interconnected to a first perpendicular pipe section at one end and a second perpendicular pipe section at another end, with the second perpendicular pipe section projecting outwardly from the elongated center section in a direction opposite the first perpendicular pipe section.

6. The method of using the snow removal system as set forth in claim 5, wherein the first perpendicular pipe section having the free end coupled with the fluid-control pipe by way of an "L" pipe connector.

7. The method of using the snow removal system as set forth in claim 4, wherein the second pipe extension that is generally "L" shaped with a pair of elongated pipe sections interconnected at the area of the pipe bend.

8. The method of using the snow removal system as set forth in claim 4, wherein the one fluid outlet of the fluid-control pipe of the indoor snow removal system is a single outlet line and the other fluid outlet has dual fluid release ends formed thereon.

9. The method of using the snow removal system as set forth in claim 8, wherein the dual fluid release ends being angularly spaced apart one from the other, and each of the dual fluid release ends having a fluid-control valve.

10. The method of using the snow removal system as set forth in claim 8, wherein the fluid inlet and one of the two fluid outlets are formed at a linearly extending pipe portion and has end portions being axially aligned, wherein one end portion couples with the first pipe extension and the other end portion couples with the second pipe extension.

11. The method of using the snow removal system as set forth in claim 10, wherein the linearly extending pipe portion having the dual fluid release ends perpendicularly extended from an interconnected pipe piece.

12. The method of using the snow removal system as set forth in claim 8, wherein the fluid inlet and one of the two fluid outlets is formed at a linearly extending pipe portion and formed of a flexible material, wherein one end portion couples with the first pipe extension and the other end portion couples with the second pipe extension.

13. The method of using the snow removal system as set forth in claim 12, wherein the linearly extending pipe portion having the dual fluid release ends perpendicularly extending from an interconnected pipe piece connected along the linearly extending pipe portion.

14. The method of using the snow removal system as set forth in claim 8, wherein the fluid inlet and one of the two fluid outlets are formed at a linearly extending pipe portion and a perpendicular pipe portion, with ends of the pipe portions being angularly spaced apart, and the linearly extending pipe portion having the dual fluid release ends extending therefrom.

15. The method of using the snow removal system as set forth in claim 8, wherein the fluid inlet and one of the three fluid outlets being formed of a "U" shaped pipe portion, formed of a rigid material, with end portions being spaced apart in parallel plans, wherein one end portion couples with the first pipe extension and the other end portion couples with the second pipe extension.

16. The method of using the snow removal system as set forth in claim 15, wherein the "U" shaped pipe portion having an interconnected pipe piece with the dual fluid release ends perpendicularly extending therefrom.

17. The method of using the snow removal system as set forth in claim 4, further including coupling a "T" connector to a cold water connection of a main cold water supply pipe of a sink at one end and couple the other end of the "T" connector to the main hot water supply pipe;

coupling a first pipe extension to the "T" connector; and coupling a second pipe extension to the hot water fluid line of the sink faucet.

* * * * *

UNITED STATES PATENT AND TRADEMARK OFFICE

CERTIFICATE OF CORRECTION

PATENT NO. : 6,442,876 B1
DATED : September 3, 2002
INVENTOR(S) : Michael V. Morse It is certified that error appears in the above-identified patent and that said Letters Patent is hereby corrected as shown below:

Column 11,
Lines 37-39, Claim 2 should read as follows:

2. The multipurpose indoor snow removal system for removing snow as in claim 1, wherein the fluid inlet and fluid outlets are made of rigid material.

Lines 40-42, Claim 3 should read as follows:

3. The multipurpose indoor snow removal system for removing show as in claim 1, wherein the fluid inlet and at least one of the fluid outlets are made of a flexible material.

Signed and Sealed this

Twelfth Day of August, 2003

JAMES E. ROGAN
*Director of the United States Patent and Trademark Office*